United States Patent [19]

Rybalko

[11] 4,346,328

[45] Aug. 24, 1982

[54] ELECTRON BEAM DEVICE WITH VARIABLE BEAM ENERGY

[76] Inventor: Sergei A. Rybalko, ulitsa Sovetskaya, 8a, kv. 94, Fryazino Moskovskoi oblasti, U.S.S.R.

[21] Appl. No.: 98,380

[22] Filed: Nov. 27, 1979

Related U.S. Application Data

[62] Division of Ser. No. 888,563, Mar. 20, 1978, Pat. No. 4,211,953.

[51] Int. Cl.[3] ..... H01J 29/46; H01J 29/58

[52] U.S. Cl. ..... 313/449; 313/450

[58] Field of Search ..... 313/433, 449, 450, 479, 313/460

[56] References Cited

U.S. PATENT DOCUMENTS 4,044,282 8/1977 Balandin et al. ..... 313/433

*Primary Examiner*—Robert Segal

*Attorney, Agent, or Firm*—McAulay, Fields, Fisher, Goldstein & Nissen

[57] ABSTRACT

Described is a beam device with variable beam energy comprising a focusing system intended to ensure constant focusing of an electron beam on a screen. The focusing system includes two electrodes successively arranged across the path of the electron beam. The first of these electrodes is electrically coupled to an accelerating electrode intended for electron beam shaping; the second electrode is connected to the screen. Interposed between the accelerating electrode and the first electrode is a variable focal power lens intended to maintain constant focusing of the electron beam regardless of changes in the energy of its electrons. The device features a high resolution and a simple control circuit.

3 Claims, 3 Drawing Figures

ELECTRON BEAM DEVICE WITH VARIABLE BEAM ENERGY

This is a division of application Ser. No. 888,563, filed Mar. 20, 1978, now U.S. Pat. No. 4,211,953, of July 8, 1980.

FIELD OF THE INVENTION

The present invention relates to electron beam devices and, more particularly, to an electron beam device with variable beam energy mainly used in display systems.

BACKGROUND OF THE INVENTION

Already known is a class of electron beam devices providing electron beams of variable energy and velocity. A change in the beam energy brings about a change in the colour of the luminescence, the duration of the afterglow, or other characteristics of the screen. The operating principle of such devices is based on the relationship between the depth of penetration of electrons of an electron beam into a solid and the energy of these electrons.

The screens of such electron beam devices may be of different types. There may be single-layer screens including particles of a material coated with other materials which serve as an energy barrier for electrons. The screen may be composed of several layers of different materials; some of these layers exhibit different properties when excited by electrons, whereas other layers serve as an energy barrier for electrons. When acting upon screens of the latter type, electrons of different energy levels penetrate into and excite different layers of the screen.

The operating principle of such screens makes it clear that the excitation of materials possessing different properties necessitates a certain increase in the energy of the electron beam's electrons.

However, the electron beam is defocused on the screen unless certain measures are taken.

Different techniques are already known which make it possible to produce a focused image on a screen with different electron beam energies (cf. UK Patent Specification No. 947,916, Cl. H4 D). In this patent specification, disclosure is made of a multi-gun electron beam shaping system, wherein each gun produces a focused electron beam possessing a certain amount of energy.

The above system is disadvantageous in that it contains a plurality of guns, which accounts for the complicated design of the system; in addition, images produced by different guns do not match on the screen.

There is also known an electron beam device with variable electron beam energy (cf. USSR Inventor's Certificate No. 441,612, U.S. Pat. No. 4,044,282), comprising a focusing system for constant focusing of an electron beam on a screen. The focusing system includes two axially symmetrical electrodes successively arranged across the path of the electron beam. The first of these electrodes is electrically coupled to an accelerating electrode intended for electron beam shaping; the second electrode is electrically coupled to the screen.

The focusing system of that electron beam device comprises a magnetic lens with a constant magnetic field intensity, and an electrostatic lens arranged with respect to the magnetic lens so as to compensate for changes in the electron beam focusing. The electrostatic lens is composed of two axially symmetrical electrodes successively arranged across the path of the electron beam. The first of these electrodes is electrically coupled to the accelerating electrode, whereas the second is electrically coupled to the screen.

The above electron beam device under review has all the disadvantages inherent in electromagnetic focusing systems, which include the complexity of aligning the magnetic lens in relation to the axis of the device, the large size and great weight of the device, the necessity of utilizing a sufficiently powerful source to energize the magnetic coil, etc. In addition, changes in the energy levels of the electrons of the electron beam make it hard to focus the electron beam; that means that for each electron beam device, one must find an optimum position of the middle plane of the magnetic lens with respect to that of the electrostatic lens, and appropriately select the potential of the accelerating electrode and the magnetomotive force of the magnetic coil.

SUMMARY OF THE INVENTION

It is an object of the present invention to provide an electron beam device with variable electron beam energy, which ensures automatic focusing of the electron beam on the screen regardless of changes in the energy of the electron beam's electrons.

The invention essentially consists in providing an electron beam device with variable electron beam energy, comprising a focusing system to ensure constant focusing of the electron beam on the screen of the device, which focusing system includes two axially symmetrical electrodes successively arranged across the path of the electron beam. The first of these electrodes is electrically connected to an accelerating electrode which serves for electron beam shaping; the second electrode is electrically connected to the screen. According to the invention, the focusing system for constant focusing of the electron beam on the screen includes a lens of variable focal power, intended to ensure constant focusing of the electron beam regardless of changes in the energy of its electrons and interposed between the accelerating electrode and the second electrode of the focusing system.

Preferably both electrodes of the focusing system should be interconnected by a means intended to produce a distributed electric field and made from a resistive material; it is preferred that the accelerating electrode should be arranged so that at least one of its end faces on the side of the screen of the electron beam device is between the axially symmetrical electrodes, within a portion of the path of the electron beam, confined by resistance values of 1/25 to 5/6 of the total resistance to electric current of the means for producing a distributed electric field, said end face of the accelerating electrode and said axially symmetrical electrodes making up the lens of variable focal power.

It is further preferred that the focusing system includes an auxiliary electrode arranged across the path of the electron beam, immediately after the accelerating electrode, and making up, together with the axially symmetrical electrodes, the lens of variable focal power; the spacing between the end faces of the auxiliary electrode on the side of the screen and the first of the two axially symmetrical electrodes should be equal to or less than 1.5 of the maximum diameter of the axially symmetrical electrodes; the ratio between the minimum diameter of the axially symmetrical electrodes and the minimum diameter of the auxiliary electrode should be 1.5 to 6.

The proposed electron beam device with variable electron beam energy features a high resolution (about 2,500 lines per screen), a simple control circuit, a reduced size and weight, and makes it possible to use power sources of a considerably reduced capacity, as compared to conventional electron beam devices.

BRIEF DESCRIPTION OF THE DRAWINGS

Other objects and advantages of the present invention will become more apparent from the following detailed description of preferred embodiments thereof when read in conjunction with the accompanying drawings, wherein.

DETAILED DESCRIPTION OF THE INVENTION

Figure 1:
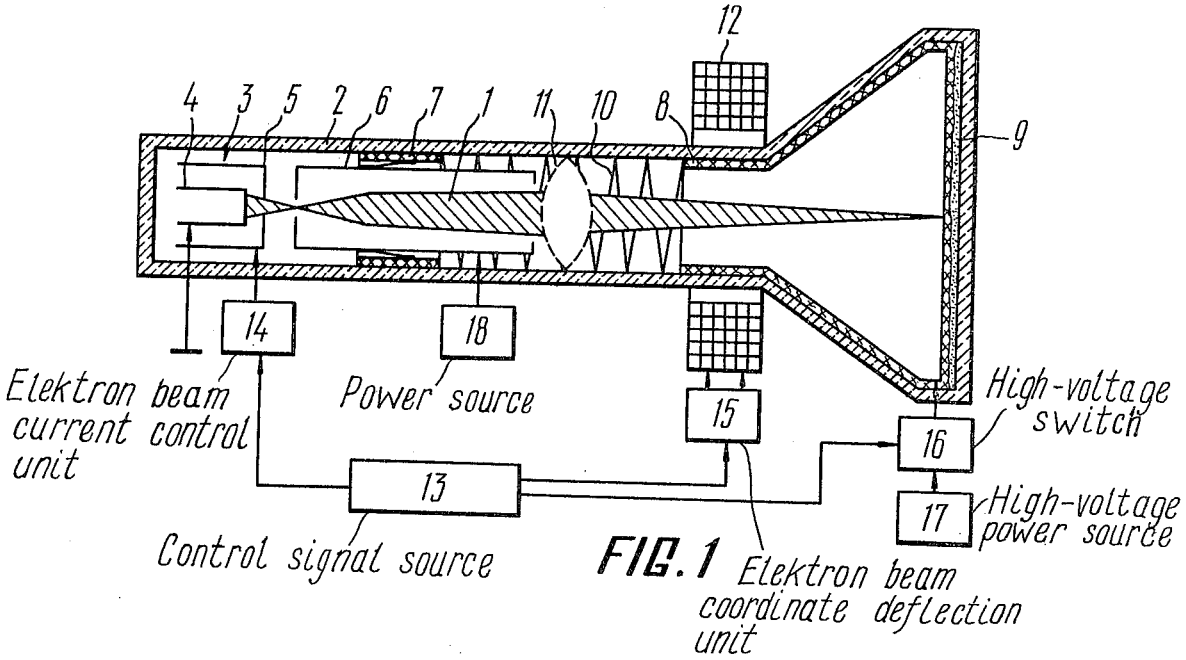
FIG. 1 is an elevational view of a first embodiment of an electron beam device with variable electron beam energy in accordance with the invention, and a block diagram of the device's control circuit.

Referring to the proposed drawings, the proposed electron beam device with variable electron beam energy comprises a coaxially symmetrical system intended for shaping and focusing an electron beam 1 (FIG. 1). The focusing system is accommodated inside a sealed casing 2 of the electron beam device, and includes an electron source 3 composed of a cathode 4 and a modulator 5.

The electron beam device of the present invention further contains a focusing system intended to ensure constant focusing of the electron beam on a screen, which system comprises an accelerating electrode 6 intended for electron beam shaping and arranged across the path of the electron beam 1, after the modulator 5, and two axially symmetrical electrodes 7 and 8 successively arranged across the path of the electron beam 1, after the accelerating electrode 6. The electrode 7 is electrically connected to the accelerating electrode 6. The electrode 8 is electrically connected to a luminescent screen 9.

Interposed between the electrodes 7 and 8 is a means for producing a distributed electric field, which is made from a resistive material and electrically coupled to the electrodes 7 and 8. The electrodes 7 and 8 are a current-carrying coating applied onto the internal surface of the sealed casing 2. The means for producing a distributed electric field is a band 10 helically extending over the internal surface of the sealed casing 2. The accelerating electrode 6 is arranged so that its end face on the side of the luminescent screen 9 is found between the end faces of the electrodes 7 and 8 facing each other; said end face of the accelerating electrode 6 is located at that portion of the electron beam path which is confined by resistance magnitudes of 1/25 to 5/6 of the total resistance to electric current of the means for producing a distributed electric field.

Arranged as described above, said end face of the accelerating electrode 6 and the electrodes 7 and 8 make up a lens 11 of variable focal power, which lens 11 is intended to ensure constant focusing of the electron beam 1 irrespective of changes in the energy of its electrons.

Arranged outside the sealed casing 2 is a means for deflecting the electron beam 1. This means is an electromagnetic coil 12 which makes the electron beam 1 scan the screen 9.

The electron beam device of this invention is controlled by control signals produced by a control signal source 13 which is connected via an electron beam current control unit 14 to the modulator 5. The source 13 is also connected via an electron beam coordinate deflection unit 15 to the deflecting coil 12, and via a high-voltage switch 16 to the screen 9. The circuitry of the electron beam coordinate deflection unit 15 is well known to those skilled in the art. The high-voltage switch 16 is connected to a high-voltage power source 17. The accelerating electrode 6 is connected to a power source 18. In the embodiment shown, the cathode 4 is grounded. According to an alternative embodiment, the accelerating electrode 6 is grounded, and negative voltage is applied to the cathode 4.

Figure 2:
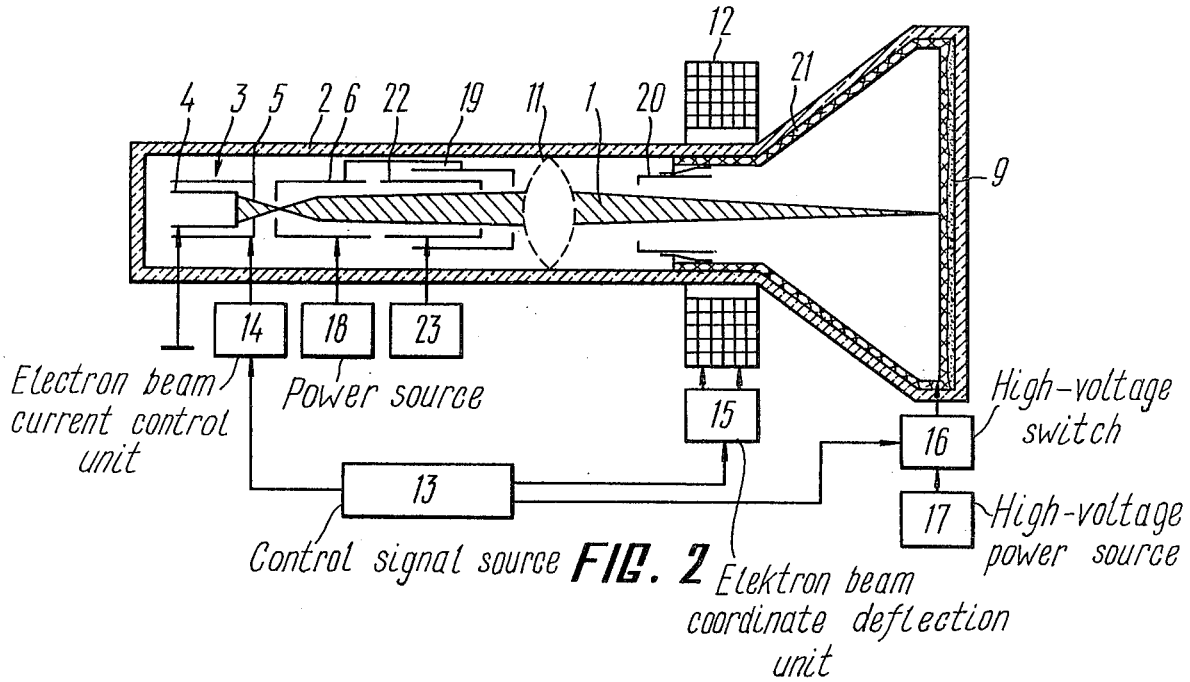
FIG. 2 is an elevational view of a second embodiment of an electron beam device with variable electron beam energy in accordance with the invention, and a block diagram of the device's control circuit.

The second embodiment is similar to the one described above, but differs from the former in that axially symmetrical electrodes 19 (FIG. 2) and 20 of the focusing system are shaped as cylinders which are not electrically interconnected. The electrode 20 is connected to the screen 9 by means of a current-carrying coating 21 applied onto the internal surface of the sealed casing 2. According to the second embodiment of the invention, the variable focal power lens 11 is composed of an auxiliary electrode 22 arranged across the path of the electron beam 1, after the accelerating electrode 6, and the electrodes 19 and 20. The spacing between the end faces of the auxiliary electrode 22 and the electrode 19, facing the screen 9, is equal to or less than the maximum diameter of the electrodes 19 and 20 multiplied by 1.5; the ratio between the minimum diameter of the electrodes 19 and 20 and the minimum diameter of the auxiliary electrode 22 is selected between 1.5 and 6. The foregoing spacing and ratio values apply to embodiments incorporating electrodes of complex configurations.

The only difference between the two versions of the proposed electron beam device, as far as their control is concerned, is that the second embodiment incorporates an additional power source 23. According to still another embodiment, the auxiliary electrode 22 is grounded, whereas appropriate voltages are applied to the cathode 4 and the accelerating electrode 6.

Figure 3:
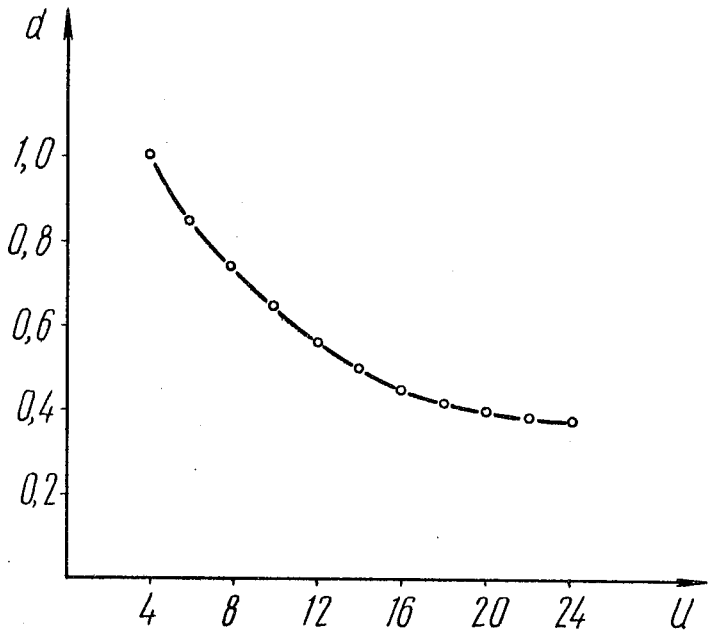
FIG. 3 is a graph illustrating the relationship between the diameter of a focused beam and an increase in the energy of the beam's electrons.

A qualitative assessment of operation of the proposed electron beam device can be obtained by constructing a graph of the type shown in FIG. 3, which illustrates the relationship between the diameter of a focused electron beam at energy levels of more than 4 keV and the diameter of the same electron beam at an energy level of 4 keV; the voltage U across the screen is expressed in kilovolts and plotted on the abscissa; the ratio d between the electron beam diameters is plotted on the y-axis.

The first embodiment of the inventive electron beam device with variable electron beam energy operates as follows.

As a signal is applied from the electron beam current control unit 14 (FIG. 1) to the modulator 5 of the electron source 3, and as accelerating voltage is applied from the power source 18 to the accelerating electrode 6, a currentmodulated electron beam 1 is produced between the electron source 3 and the accelerating electrode 6.

Let it be assumed that the lesser of the two preset working voltages is applied to the screen 9 and, consequently, to the electrode 8. By changing the magnitude of the accelerating voltage applied from the power source 18 to the accelerating electrode 6, one produces a sharp image of the cross-over, which is a spot of a minimum size on the screen 9. This means that the lens 11 of a certain focal power is produced between the end face of the accelerating electrode 6, which is on the side of the screen 9, and the electrode 8. An increase in the voltage across the screen 9 changes the distribution of the potential along the axis of the device, between the end face of the accelerating electrode 6 on the side of the screen 9, and the electrode 8; this is accompanied by a displacement of the principal plane of the lens 11 towards said end face of the accelerating electrode 6.

The two processes, i.e., the change in the focal power of the lens 11 and the displacement of its principal plane, help to maintain a well-focused spot on the screen 9 of the electron beam device.

Operation of the second embodiment of the proposed electron beam device is similar to that of the first embodiment.

The difference is that the variable focal power lens 11 (FIG. 2) is produced between the end face of the auxiliary electrode 22, facing the screen 9, and the end face of the electrode 20, facing the cathode 4.

The plot of FIG. 3 shows that in the proposed electron beam device with variable beam energy, an increase in the energy of the beam's electrons decreases the diameter of the electron beam 1 focused on the screen 9. This presents a contrast to conventional electron beam devices which have two optimum electron beam focusing points on the screen (for example, at U of 6 and 12 kV); between these points, there is a slight increase in the diameter of the focused electron beam, whereas at voltages below the first and above the second levels, strong defocusing is observed.

The variable focal power lens in accordance with the present invention accounts for a high resolution (of up to 2,500 lines per screen) at beam currents of up to 100 mua.

Keeping in mind that changes in the focal power of said lens follow changes in the potential of the screen, while the potentials of all the other electrodes are constant, it is noteworthy that the subject electron beam device imposes no limitations upon the operating speed; the only element that determines the operating speed of the electron beam device is the high-voltage switch which determines the energy of electrons of the electron beam at each instant of time.

What is claimed is:

1. An electron beam device with variable electron beam energy comprising:

a sealed casing;

an electron source in said casing for shaping an electron beam;

a luminescent screen in said casing;

focusing means arranged in said casing for maintaining the optimal diameter of said beam in the plane of said screen with changes in the energy of the electrons of said beam;

an accelerating electrode for said focusing means having an input aperture for also shaping said beam; said electrode being positioned across the path of said beam, after said electron source;

a first auxiliary electrode for said focusing means arranged across the path of said beam and located after said input aperture of said accelerating electrode and electrically coupled therewith;

a second electrode for said focusing means and axially symmetrical with said first electrode and arranged across the path of said beam after said first electrode and electrically coupled to said screen by means of a current-carrying coating on the internal surfaces of said casing;

a gap in said focusing means forming a variable focal power lens ensuring adequate compensation for the influence of changes in the energy of electrons of said beam on the diameter of said beam in the plane of said screen;

said gap being located between said first auxiliary electrode and said second electrode of said focusing means;

a third auxiliary electrode for said focusing means positioned across the path of said beam after accelerating electrode but before said gap;

there being a spacing between the end faces of said third electrode and said first electrode facing said screen;

said spacing being equal to or less than the maximum diameter of said first electrode multiplied by 1.5; and the ratio between the minimum diameter of said first electrode and the minimum diameter of said third electrode ranging between 1.5 and 6.

2. The device of claim 1, wherein said third electrode is grounded.

3. The device of claim 1, wherein the end face of said accelerating electrod is located at that portion of said beam which is confined by resistance magnitudes of 1/25 to 5/6 of the total resistance to electric current of said source.

* * * * *